United States Patent [19]

Gualano

[11] 4,103,305

[45] Jul. 25, 1978

[54] UNIVERSAL ANTENNA MOUNT

[76] Inventor: Emil V. Gualano, P.O. Box 902, Huntington Park, Calif. 90255

[21] Appl. No.: 708,383

[22] Filed: Jul. 26, 1976

[51] Int. Cl.[2] ..... H01Q 1/32; H01Q 1/12

[52] U.S. Cl. ..... 343/715; 343/882

[58] Field of Search ..... 343/713, 715, 878–882, 343/900

[56] References Cited

U.S. PATENT DOCUMENTS

| | | | |
|---|---|---|---|
| 2,471,020 | 5/1949 | Benton | 343/900 |
| 2,481,801 | 9/1949 | Valach | 343/880 |
| 3,369,247 | 2/1968 | Bacow | 343/715 |
| 3,403,404 | 9/1968 | Berger et al. | 343/713 |
| 3,408,652 | 10/1968 | Allisbaugh | 343/906 |

FOREIGN PATENT DOCUMENTS

| | | | |
|---|---|---|---|
| 868,438 | 5/1961 | United Kingdom | 343/907 |

*Primary Examiner*—Eli Lieberman

*Attorney, Agent, or Firm*—Larson, Taylor and Hinds

[57] ABSTRACT

An antenna mount formed of a block, preferably of non-metallic material, is formed with parallel opposed sides and apertures extending therebetween. These apertures permit mounting of the block on virtually any surface or connection to a clamping device wherein the latter is connectable to any surface and provides a pivot movement of the block about said connection. Internally, the block includes an antenna receiving opening in the upper surface thereof in a first passageway, and one or more further passageways which intersect the first passageway, and any one of which can include a fixed or removable nipple arranged for connection to a standard coupling and through which an electrically conductive pin extends for providing a passage for the antenna signal from the antenna base to the antenna wire of the coupling. A ground connection on the nipple may include a ring on the outer end thereof with a leg extending parallel to the nipple axis and a ground wire connected to the opposite end thereof.

16 Claims, 12 Drawing Figures

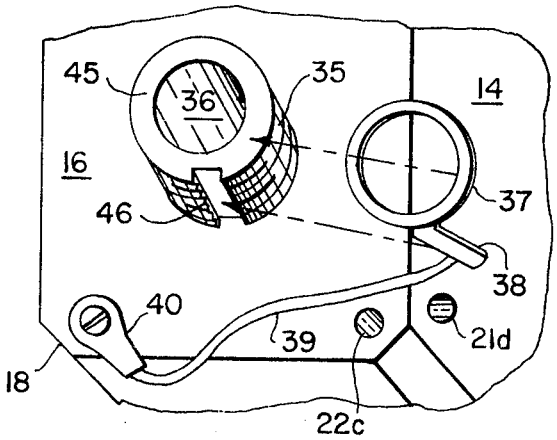
FIG. 4
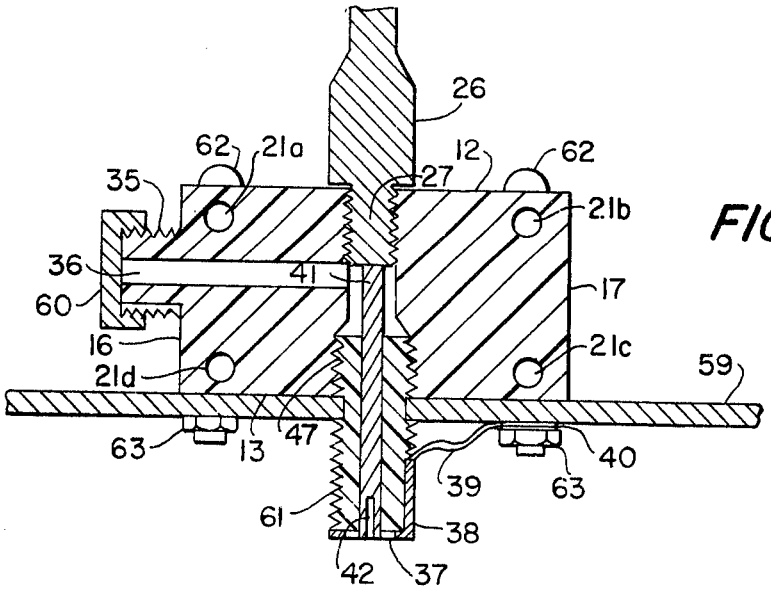
FIG. 5
FIG. 6A
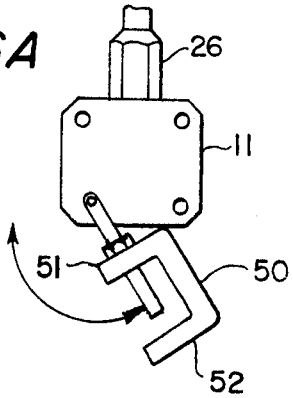
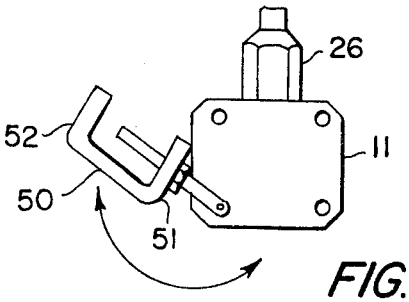
FIG. 6B

UNIVERSAL ANTENNA MOUNT

BACKGROUND OF THE INVENTION

This invention relates to antenna mounts, and in particular it relates to antenna mounts of the type adapted for use on a vehicle.

It is at present quite popular to use in conjunction with a vehicle an appliance such as a citizen band radio, also known as a CB radio, which requires the use of an outside antenna. Unlike manufacturer supplied radios or the like for which the antenna and the antenna mount are normally incorporated in the original design of the vehicle, CB radios are often applied to the vehicle by the owner after he has purchased the vehilce. This however presents certain significant problems. For different makes and styles of automobiles, the exteriors differ from each other in shape and other design aspects. Further, even on a single given automobile, there are a number of different locations on the vehicle at which the owner might wish to mount and antenna. Examples would include the roof, the truck lid, side panels, the bumper, rain gutters, etc. Such diversity poses the dual problems of expense and strength, i.e., the strength of the connection of the mounting to the vehicle.

If a special antenna mount were made for each and every specific mounting location for each and every vehicle, the volume of each which could be manufactured would be so small that the cost would be quite high, perhaps prohibitive. Alternatively, if a single type of mount adapted for a certain type of mounting situation such as a horizontal surface, i.e., a roof or truck lid, were sold in large numbers and hence at a reasonable cost, and then modified for use at other mounting locations, as is believed to be the present practice, then there is in fact presented the dual problems of expense and strength, in this case the increased expense of providing means such as specially designed brackets and the like to adapt the mount for use in such different mounting situations such as on a vertical surface, on a rain gutter, etc., and the reduction in the strength of the mount-vehicle connection when used in situations other than those for which the mount was originally intended. In such cases wherein the connection lacks the strength which exists in the situation for which it was originally designed, the mount could break off, causing damage to the mount, the antenna and possibly to other persons or vehicles on the road in the case of a motor vehicle.

Hence, there exists a need for a mount design which, without significant modification or special adapting means can be universally applied to a diversity of different mounting situations, and wherein in each situation the strength of the connection between the mounting and the vehicle remains high.

SUMMARY OF THE INVENTION

It is therefore a purpose of the present invention to provide a mount for an antenna or the like which can be universally applied to a diversity of mounting situations, and in each of which the mount can be strongly secured in place.

In accordance with the present invention there is provided a mount having a body in the form of a block which is preferably formed of a non-metallic and hence electrically insulating material. An opening is provided in the top of the body for receiving the base of the antenna. This opening extends into the block to form a first passageway therein. The block includes a second passageway opening into a second surface thereof which second passageway includes a nipple extending outwarding from the block for receiving the coupling containing the wire leading to the appliance such as the CB radio or the like. Such couplings are standardized and normally include the antenna wire in the central portion thereof and a ground connection encircling the same. An electrically conductive pin is provided in the second passageway so as to contact the antenna base at the juncture of the first and second passageways and so as to contact the antenna wire of the coupling at the outer end of the second passageway in the vicinity of the nipple. Also associated with the nipple is a suitable ground connection.

The block is preferably formed with a plurality of pairs of opposed parallel surfaces, and when more than one such pair is provided, each additional pair of such surfaces is preferably perpendicular to each other such pair so that when three such pairs are provided, there is provided a structure, the three pairs of which lie in planes which form a parallelpiped, to be referred to for convenience hereinafter as a rectangular block.

Apertures extend completely through the block between at least one but preferably more of the pairs of opposed parallel surfaces. This permits the block to be applied flush against a given surface so that bolts or the like can extend through the apertures associated with that surface and then through the mounting surface for connection thereto. In conjunction therewith, the nipple and the second passageway associated therewith can be formed in any surface of the block except the top surface. Hence, regardless of which block surface is located flushed against a mounting surface, the nipple and second opening can be arranged to pass through that mounting surface (as would be the case for example if the bottom surface of the block were located against a roof or trunk lid and its was desired to have the second opening also pass through that roof or trunk lid) or alternatively the second opening and nipple can extend out a side of the block other than the side located against the mounting surface. The block can include openings in any of its surfaces adapted to receive a removable nipple, and in combination therewith or in lieu thereof the block may include a single fixed nipple in one of its surfaces.

In addition, one of the apertures can include therein a bolt which serves as a pivot axis for mounting the block to a known type of C-shaped clamp which in turn can be used to mount the block on any type of edge surface such as any edge on the body of the vehicle, a rain gutter, a bumper, etc. The C-shaped clamp connection to the block can be such as to permit substantial swivelling, preferably at least 180°, for adjusting the block relative to the clamp.

The present invention also includes a novel ground connection associated with the nipple including a ring at the outer end thereof and a lead therefrom. Also, a further opening may be provided in the block for drilling a hole therethrough and through the antenna base and for placing a pin therein to permanently secure the antenna in the base, thereby providing security against theft in situations where it is not necessary to permit temporary removal of the antenna from the block.

Hence, it is an object of this invention to provide a new and improved mount for an antenna or the like.

It is another object of this invention to provide an antenna mount adapted to be universally used in a diversity of different mounting locations and situations, wherein a strong connection of the mount is achieved.

It is still another object of this invention to provide a mount for an antenna or the like comprising a block, preferably of non-metallic material, including an opening in the top thereof forming a first passageway for receiving and securing an antenna base, and a second opening in a second passageway thereof including a nipple for receiving a coupling from the applicance and means for providing an electrically conductive path for the radio signal from the antenna base to the coupling.

It is still another object of this invention to provide a mount for an antenna or the like having a plurality of opposed parallel surfaces with apertures extending between each pair of opposed surfaces for mounting such opposed surfaces flush against a surface of the vehicle.

It is still another object of this invention to provide a mount for an antenna or the like having a plurality of opposed parallel surfaces, each pair being perpendicular to each other pair thereby providing a plurality of surfaces, each at a different angle and location relative to the antenna receiving top surface, for mounting of the block against various surfaces of a vehicle or the like.

It is still another object of this invention to provide a mount for an antenna or the like having means for pivotally receiving a clamp which in turn can be connected to diverse portions of a vehicle or the like wherein the block is pivotable relative to the clamp.

It is another object of this invention to provide a mount for an antenna or the like including a new and improved ground connection for the coupling leading to the appliance.

It is still another object of this invention to provide a mount for an antenna or the like including a block which receives the antenna base and which includes a means for permanently securing the antenna base within the block.

It is still another object of this invention to provide a mount for an antenna or the like having an opening in the top thereof forming a first passageway for receiving an antenna base and the possibility of providing a second opening in at least several of the other block surfaces for conducting the antenna signal therethrough for connection to the coupling leading to the appliance.

These and other objects of the invention will become apparent from the detailed description to follow, together with the accompanying drawings.

BRIEF DESCRIPTION OF THE DRAWINGS

There follows a detailed description of preferred embodiments of the invention to be read together with the accompanying drawings wherein:

FIG. 4 is a partial enlarged perspective view of a portion of FIG. 1 with certain parts separated for clarity.

FIG. 5 is a cross-sectional view similar to FIG. 2 but showing a different application of the antenna mount.

FIGS. 6A and 6B are schematic side elevation views of FIG. 1 intended to illustrate certain operational features of the present invention.

DETAILED DESCRIPTION OF THE PREFERRED EMBODIMENTS

Figure 1:
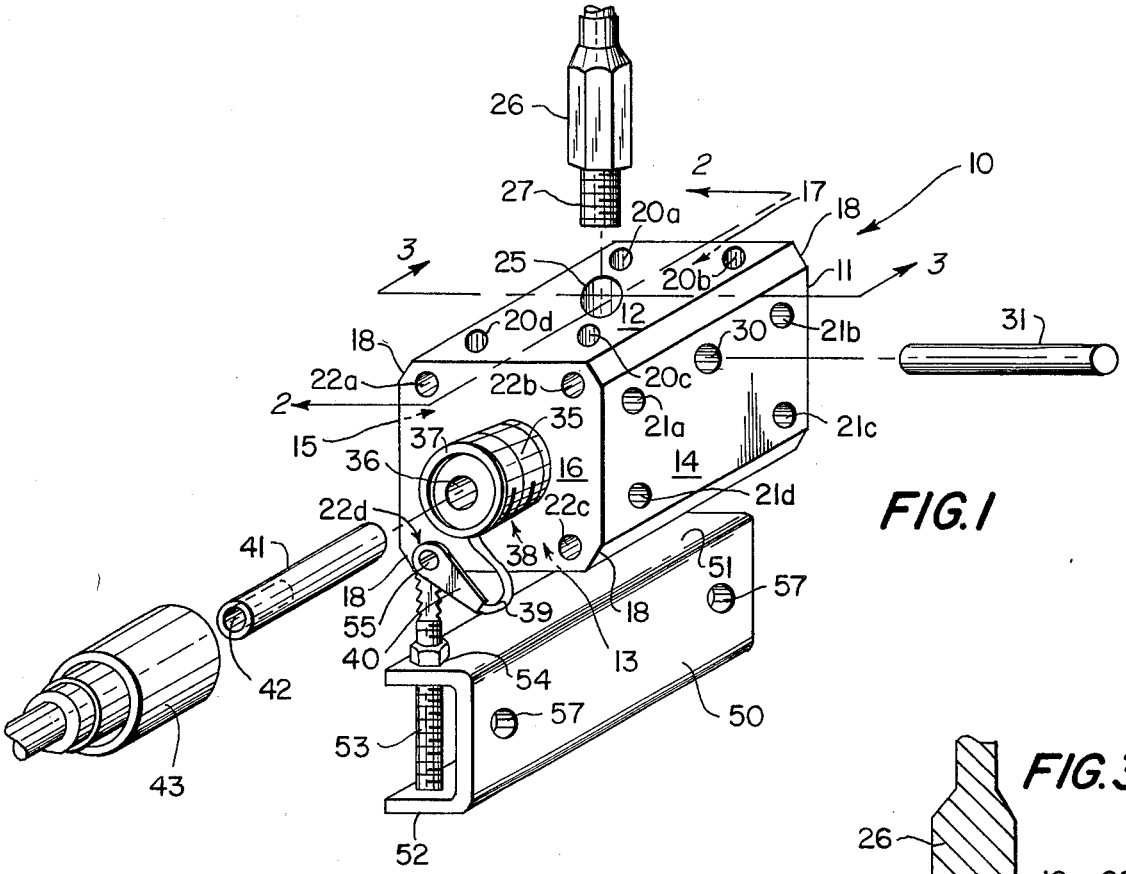
FIG. 1 is a perspective view, partially exploded, showing an antenna mount in accordance with the present invention.

Referring now to the drawings, like elements are represented by like numerals throughout the several views.

Referring to FIGS. 1 through 4, the antenna mount 10 includes a body 11 in the form of a block, preferably of non-electrically conducting material such as a non-metallic material and preferably of a high strength nylon. High strength materials, in addition to providing greater overall durability provide a material which will hold threads which must be formed therein or thereon better than a lesser strength material.

The block 11 includes a top 12 and a bottom 13 parallel to the top. The block further includes flat parallel sides 14 and 15. The block also includes flat parallel ends 16 and 17. The block is preferably chamfered along the four long edges as indicated at 18. An advantage of the present invention is that any one of the side, ends or bottom can be mounted flush against a receiving surface. To accomplish such mounting, apertures are provided in the block. The four apertures **20*a* through 20*d* pass from top 12 to and through the bottom 13. When mounting the block with bottom 13 against a horizontal surface (refer briefly to FIG. 5) bolts may be provided in any two or more of the apertures 20*a* through 20*d* for connecting the block to said surface. Similarly, apertures 21*a* through 21*c* pass completely through the block between side surfaces 14 and 15 whereby either of these side surfaces can be mounted flat against a vertical surface (refer briefly to FIG. 9A). Finally, the four apertures 22*a* through 22*d* pass completely through the block between ends 16 and 17. Bolts may be passed therethrough for mounting either of these ends against a flat vertical surface (refer briefly to FIG. 9B). Alternatively, these apertures may be used for a rod such as a bolt or the like to serve as a pivot axis for mounting the block to a clamp as shown for example in FIG. 1**.

The block includes an opening 25 in the top thereof which is preferably threaded for receiving the threaded portion 27 of the antenna base 26, the upper portion of the antenna having been cut off for convenience. This opening 25 extends downwardly at least some distance beneath the bottom of the base 27 to form the bottom of a first passageway.

Many persons prefer to remove the antenna 26 either for storage during a period of non-use or to prevent theft. However, if one does not wish to remove the antenna 26 from the mount, in accordance with the present invention there is further provided a means for permanently securing the antenna in place. Referring to the Figures, the block 11 includes a blind hole commencing at opening 30 and terminating at less than the full distance through the block. With the antenna base 27 in place, a drill enters the opening 30 for drilling a hole directly through said portion 27. A pin 31 can then be placed into opening 30 and through the hole within base 27 and therebeyond. If the pin is made of the same material as the block, i.e., if both are for example of nylon material, then a touch of acid at the outer end of the pin 31 at opening 30 will permanently lock the pin in place. Even in the absence of such treatment, it would be most difficult to remove the pin except by drilling a hole in from the other side of block 11 and pushing the pin out. For this purpose, a suitable marking may be placed on the block opposite opening 30 to advise the owner as to the location of the axis of pin 31.

Figure 2:
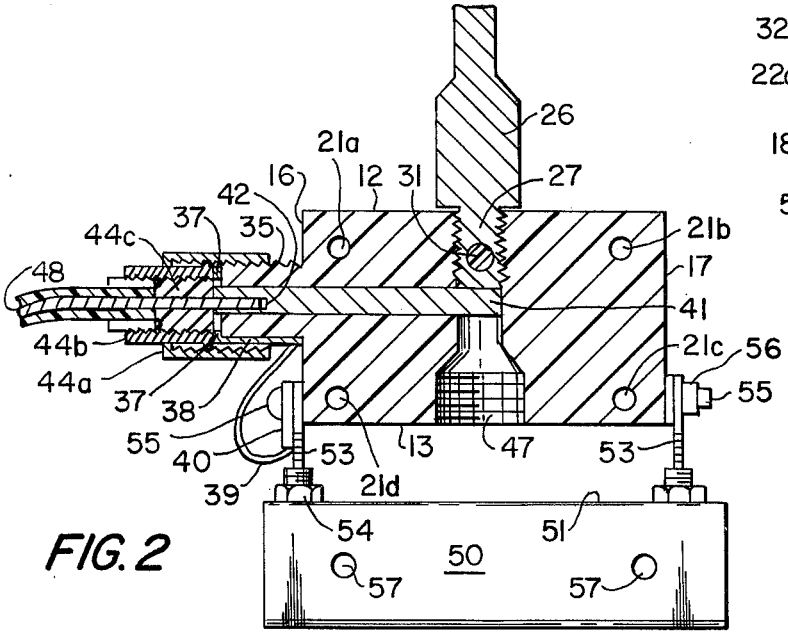
FIG. 2 is a cross-sectional view taken through a vertical plane represented by the line 2—2 of FIG. 1 but with the various parts which were removed in FIG. 1 in place in FIG. 2.

Block 11 further includes a threaded nipple 35 extending outwardly from the side 16. Referring to FIG. 4, this nipple includes an outer end 45 and a lower groove 46. For cooperating therewith there is provided a metallic ring 37 which fits against end 45 and a stem 38 which extends at right angles to the plane of ring 37 and fits snugly within the groove 46. From the end of stem 38 a wire 39 is provided which leads to a pigtail 40 which can be connected to any suitable ground location. An opening 36 extends through the nipple 35 and continues through the block 11 constituting a second passageway which then intersects with the first passageway. i.e., the passageway extending downwardly from opening 25. A metallic pin 41 preferably having a blind opening 42 at one end thereof, is removably inserted within opening 46. With elements 37, 38 and 41 in place, the block is ready to receive the standard well known military specification coupling represented schematically as 43 in FIG. 1. As is well known, this standard coupling includes an outer collar **44*a* which threadedly engages the nipple 35, a further metallic collar 44*b*, the inner end of which engages the ring 37, thereby providing a ground connection through elements 44*a*, 44*b*, 37, 38 and 39 to 40. Within collar 44*b* is a body of insulating material 44*c* separating elements 44*a* and 44*b* from the antenna wire 48, the inner end (the right hand end as shown in FIG. 2) of which extends into the opening 42 in the metallic pin 41 thereby forming an electrically conducting path therewith. The inner end of pin 41 makes contact with the bottom of base 27. There is thus provided an electrically conductive path for the radio signal from antenna 26 through elements 27, 41, 42, and 48** to the CB radio.

Figure 3:
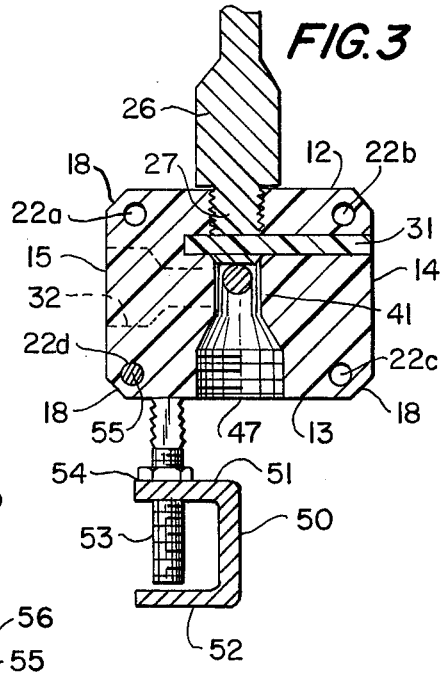
FIG. 3 is a cross-sectional view taken through a vertical plane represented by the line 3—3 of FIG. 1 but with the various parts which were removed in FIG. 1 in place in FIG. 3.

The versatility of the present invention is provided in part by the fact that the second passageway which passes through nipple 35 in FIGS. 1 through 4 can be provided instead at other locations and can be provided instead with a removable nipple rather than a fixed nipple. FIG. 2 illustrates a threaded opening 47. FIG. 3 illustrates in dotted lines a possible further opening 32 which, if desired, could be provided and would be identical to opening 47. Referring momentarily to FIG. 5, there is shown an arrangement wherein the opening 47 is used for transmitting the signal to the coupling rather than nipple 35. As shown in FIG. 5, a dust cap or the like is simply threaded over the nipple 35. A removable nipple 61 is then threaded into the opening 47. Below the bottom 13 this nipple is essentially identical to the nipple 35. The essential difference is that instead of being formed as a part of block 11, this nipple is threadedly received therein so that it can be easily removed when not used. Another feature of the element 61 is that its axial length and in particular its distance beneath the bottom 13 should be such that the same pin 41 should be usable therewith. Therefore, since the opening 47 extends a smaller distance to the external surface of the block than opening 36, this of course means that the nipple 47 should extend outwardly a sufficiently greater distance than nipple 35 so as to provide said equal length interior for pin 41. The coupling 43 would then be connected to nipple 51 in precisely the same manner as described above with respect to nipple 35.

An important feature of the present invention is the ease with which it may be strongly and universally applied. Referring to FIGS. 1 through 3, there is illustrated a first mounting arrangement wherein a C-shaped clamp 50 having an upper leg 51 and a lower leg 52 is connected to block 11 by means of spade bolts 53 which pass through openings in the upper leg 51 where they are secured in place by nuts 54. The upper portions of bolts 53 are flatened as shown in the figures and the uppermost portion of each is placed adjacent one of the apertures 22, in this case the aperture **22*d*, whereat along with pig-tail 40 they are secured to the block by a suitable bolt 55 and nut 56**.

In practice, the clamp 50 with screws 53 thereon but separated from block 11 could then be clamped onto virtually any surface on the automobile including a rain gutter, an edge of a door, an edge of a bumper, and so on. With the clamp in place the block 11 would then be connected thereto by bolt 57 and nut 56. Referring to FIGS. 6A and 6B it will be seen that the clamp is capable of moving approximately 180° about the pivot axis of bolt 55 relative to block 11. It is this possibility which permits clamp 50 to be connected to viturally any edge while concurrently leaving the block 11 in an upright position for the antenna 26 to extend upwardly therefrom. Alternatively, the clamp 50 can simply be placed against any flat surface such as the slanted quarter panel of an automobile and secured thereto by bolts passing through holes 57 and through the said panel to which the clamp is attached.

With the arrangments specifically shown in FIGS. 1 through 4, if the mount is mounted on the right hand rain gutter, i.e. the passenger side, then the nipple 35 would extend rearwardly. Perhaps it would be desirable to extend the nipple forwardly rather than rearwardly. This could be accomplished in several ways. Firstly, the block could be provided with a removable nipple 35 instead of a fixed nipple and with a further second passageway opening similar to openings 47 or 32 in the end 17. Alternatively, with precisely the structure shown in FIG. 1, the clamp 50 can be removed and turned 180° about a vertical axis and pivotally connected to a bolt 55 passing through aperture **22*c* instead of 22*d***.

Figure 8A:
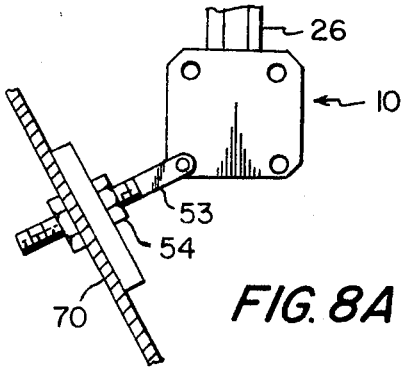
FIG. 8A is a modification of the invention.

Several factors contribute to the ability of the clamp 50 to turn through as much as 180° relative to the block. As mentioned above, a high strength material is preferred. This permits the provision of smaller apertures **22*a* through 22*d* and makes it possible to place these apertures closer to the edges ajoining the tops and sides 12 through 16. If desired, 2 case hardened steel sleeves can be placed around the flattened portioned of the spade bolts 53 below block 11 to prevent theft by cutting the spade bolts 53. Steel sleeves are loose fitting and would merely spin around when contacted with hack saw blade. Also, chamfers 18 are provided at these edges. In addition, the spade bolts 53 which are normally manufactured with only a flattened head are modified to extend the flattened portion a greater distance down the shank. A net result of all of these factors is the ability of the clamp to pivot through said 180° as described above and shown in FIGS. 6A and 6B. Alternatively, the spade bolts 53 can be passed directly through surface 70, preferably with a mounting plate lying against the outer side of the surface 70, with the lock nuts 54 in place against such plate and with securing nuts and washers as required on inner side of surface 70. This arrangement with block 11** in a proper position is shown in FIG. 8A.

Figure 7:
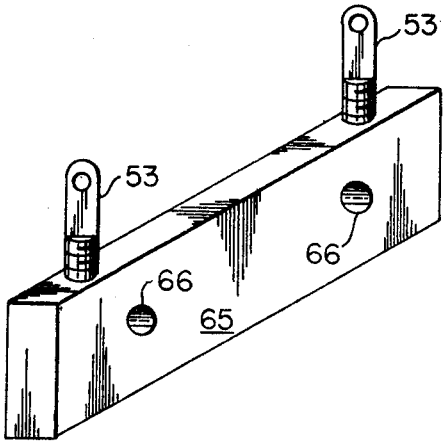
FIG. 7 illustrates a modified clamp portion for use with the present invention.
Figure 8:
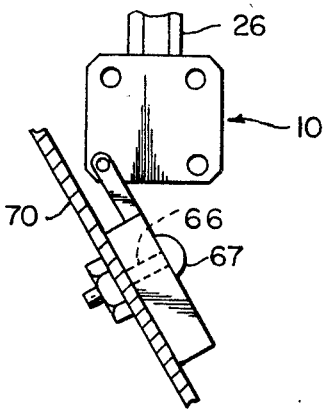
FIG. 8 is a schematic side elevational view of the invention illustrating the use of the modified clamp of FIG. 7.

When it is desired to place the clamp 50 against a flush surface rather than on an edge, i.e., to utilize the holes 57, it would be equally appropriate to use instead of clamp 50 a simple block as shown at 65 in FIG. 7 with openings 66 passing therethrough. FIG. 8 illustrates how such a clamp would be used with bolts 57 for connecting the clamp to a flush slanted surface 70. FIG. 8 of course also inherently illustrates the manner by which clamp 50 would be connected to said surface 70 wherein the outer ends of arms 51 and 52 (the left ends as shown in FIGS. 1 and 3) would abut the surface 70.

As described above, an advantage of the present invention is that any of the surfaces 13 through 17 of block 11 can be applied flush against a mounting surface. In combination therewith one must consider whether it is desirable to have the nipple also extend through that surface or extend out from the block other than through the mounting surface, and if the latter, in which direction. With second passageways provided through nipple 35, either fixed or removable, or through alternative second passageways 47 or 32, any possible combination can be achieved. FIG. 5 illustrates an arrangement wherein it is desirable to connect block 11 to a horizontal mounting surface 59 which may be a vehicle roof or trunk lid and to also have the second passageway pass therethrough. Hence, as shown in FIG. 5, a simple dustcover covers the nipple 35 while a removable nipple 61 which was previously described is inserted into opening 47. Elements 37, 38 and 41 are mounted thereto in the manner described above and the coupling 43 is then applied directly onto nipple 61. The block is held in place by suitable bolts 62 passing through any two or more of the openings **20*a* through 20*d* (in FIG. 5 the bolts are shown passing through openings 20*a* and 20*d*) and through holes drilled in the mounting surface 59 beneath which the bolts are held in place by nuts 63. The pigtail 40 is simply placed onto the lower end of bolt 62 above nut 63** to provide the ground connection.

Figure 9A:
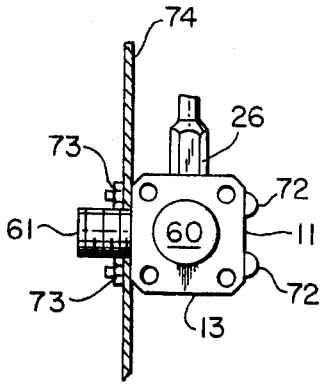
FIGS. 9A and 9B are schematic end and side elevational views, respectively, of the antenna mount of the present invention, illustrating different applications thereof.
Figure 9B:
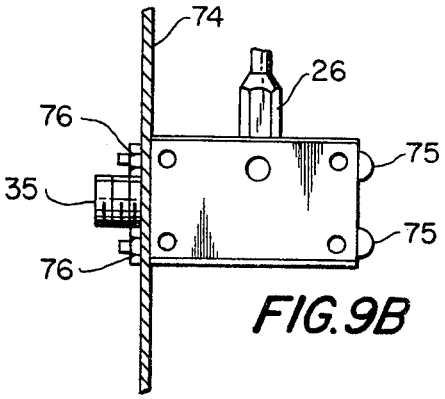

FIGS. 9A and 9B illustrate schematically other possible arrangements. FIG. 9A illustrates an arrangement wherein it is desired to place side surface 15 against a vertical mounting surface 74 with the coupling extending therethrough. In this case the block is contructed to include a second opening in the area of dotted lines 32, and a suitable nipple such as the removable nipple 61 is mounted therein. Bolts 72 are provided through the openings **21*b* and 21*d* and these are held in place by suitable nuts. FIG. 9B illustrates an arrangement wherein it is desired to mount the end 16 against a vertical mounting surface 74 with the coupling nipple 35 extending also through surface 74. This may be accomplished as shown in FIG. 9B by permitting the nipple 35 to extend through surface 74 and to secure the block in place by suitable bolt 75 provided for example in apertures 21*a* and 21*c* and secured in place by suitable nuts 76**.

Although the invention is of course applicable for any dimensions, some dimensions in practice can be dictated by a desire to adapt the antenna mount for use with a standard type of coupling. For example, according to military specifications, the antenna base 27 and the threads associated therewith have a diameter of three-eighths of an inch with 24 threads to the inch and the coupling element **44*a* and hence the nipples associated therewith have a diameter of five-eighths of an inch with 24 threads to the inch. The pin 41 should be of such a length that its outer end lies in a plane coincident with the outer surface of ring 37 in order to provide the required mating for use with a military specification coupling 43. Near the corners of the block, the longer apertures 22*a* through 22*c* are preferably as small as possible, in a preferred arrangement one-eighth of an inch diameter so that they can be brought closer to the corners, to thereby facilitate the above described turning movement of the clamp about the block 11**.

The block 11 is constructed of a non-metallic material so as to provide insulation as required. Such non-metallic material is also desirable to reduce impedance losses which would occur during transmission through an antenna mount having a large body of metal the size of block 11. However, aside from impedance losses, and assuming proper insulation where required, as for example along the path of the radio signal from antenna base 27 and through pin 41, the mounting characteristics of the invention could of course still be achieved with a metal block 11. Hence, if it were desired to use the antenna mount solely for reception and notfor transmission so that impedance was not a problem, one could use a metal block provided with suitable insulation as described above such as for example a non-metallic liner through the first and second passageways and with a non-metallic nipple portion separating the radio signal path from the ground path.

Although the invention has been described in detail above with respect to preferred embodiments thereof, it will be apparent that the invention is capable of numerous modifications and variations apparent to those skilled in the art without departing from the spirit and scope of the invention as defined in the claims.

I claim:

1. A mount for an antenna or the like comprising:

a body in the form of a substantially rectangular block, said block being formed of an electrically insulative material having a first pair of opposed surfaces forming the top and bottom of the block, respectively, said first opposed surfaces including flat substantially parallel portions, and a second pair of opposed surfaces forming lateral sides of the block and having opposed flat substantially parallel portions which are essentially perpendicular to the first said pair of opposed flat parallel portions, apertures in said block in at least one of said pairs of flat substantially parallel portions for receiving means for mounting said block, a first opening in the top of the block forming a first passageway into the block and including means for receiving an antenna base, and a second opening extending into a second surface of the block and forming a second passageway intersecting the first passageway, a nipple associated with the second opening for receiving an antenna wire coupling, and means in the second passageway for communicating a signal from the antenna base to the antenna wire.

2. A mount according to claim 1, including means defining a pivot axis extending through the block, a C-shaped clamp for mounting thereof onto an object which extends between the legs of the C including a pair of bolts extending upwardly beyond the top of the C-shaped clamp, said bolts pivotally connected to said pivot axis, whereby the block and the C-shaped clamp are pivotable about the pivot axis relative to each other.

3. A mount according to claim 2, including rear apertures extending through the C-shaped clamp perpendicular to the back thereof, so that the C-shaped clamp can be placed up against a flat surface and secured thereto by bolts or the like passing through the said rear apertures, said C-shape clamp being pivotable through at least 180° relative to the block.

4. A mount according to claim 1, including means defining a pivot axis extending through the block, a pair of rods pivotally connected to the pivot axis and extending outwardly therefrom, and a second block connected to the rods at a point spaced from the first block and means for connecting the second block to a surface for connecting the mount thereto.

5. A mount according to claim 1, said block being formed of a non-metallic material and including a third pair of opposed surfaces substantially perpendicular to the first said pairs of opposed surfaces such that the six flat sides substantially form portions of a parallelpiped.

6. A mount according to claim 5, wherein all three pairs of opposed parallel surfaces including apertures extending therebetween, so that any surface except the top surface can be mounted against a base surface and secured thereto by bolts extending through the apertures associated with the said surface mounted against the base surface.

7. A mount according to claim 6, wherein for parallel edges of the parallelpiped are chamfered, and wherein at least one of the apertures extending parallel to the chamfered edges is parallel to said chamfered edge and closely adjacent thereto.

8. A mount according to claim 7, including a rod extending through the at least one aperture to form a pivot axis, and a clamp device connected to said rod for pivotal movement thereabout of at least 180° without interferring with the said block.

9. A mount according to claim 5, said block being formed of nylon material, and said means for conducting a signal including an electrically conductive pin located in the second passageway.

10. A mount according to claim 1, and including a third opening into a third surface for receiving a said nipple and including a third passageway therethrough intersecting the first passageway, at least one of the nipples being removably mountable in its respective opening, and said means for conducting a signal comprising an electrically conductive pin removably mounted in the passageways of either of said nipples.

11. A mount according to claim 10, the second opening located in a side of the block and the third opening located in the bottom of the block.

12. A mount according to claim 1, said block being formed of non-metallic material, and said nipple including a ground device associated therewith including an electrically conductive ring located against the outer end of the nipple and positioned to engage the ground connection of the standard coupling, and a leg extending from said ring toward the block in a groove formed within the contour of the nipple, and a ground wire extending from the end of the leg remote from the ring, whereby when the standard coupling is secured onto the nipple with its ground connection engaging the ring, the standard coupling encircles the nipple to secure the ring and leg in place on the nipple.

13. A mount according to claim 1, said block being formed of non-metallic material, and including a pin extending from a surface of the block through the antenna base to permanently secure the antenna base in place in the block.

14. A carrier device of an automobile or the like comprising:

a C-shaped clamp having an upper leg, a base and a lower leg, a pair of threaded openings through the upper leg, a pair of threaded bolts threadedly engaged with the openings in the upper leg, each of said bolts having an aperture through an upper part thereof located above the upper leg, said bolts extending far enough below the upper leg of the C to clamp a supporting surface of an automobile or the like between the bottom of the bolts and the lower leg of the C while said apertures are located above the upper leg, a mounting member located between the bolts above the upper leg, and rod means passing through the said apertures and supporting the mounting member, whereby the mounting member is pivotable about said rod means for movement of the mounting member to different positions.

15. A carrier device according to claim 14, said mounting member positioned sufficiently far above the upper leg to pivot between an operative position and an inoperative position turned 90° therefrom about the pivot axis of said rod means to direct an object which normally extends upwardly in the operative position across horizontally in the inoperative position.

16. A carrier device according to claim 15, said rod means being a further bolt which extends through both of the apertures of the first said bolts and through said mounting member, and means for tightening the mounting member to the first said bolts to secure the mounting member in any of said positions.

* * * * *